US008302324B1

(12) United States Patent
Connelly

(10) Patent No.: US 8,302,324 B1
(45) Date of Patent: Nov. 6, 2012

(54) OSCILLATING HAIR DRYER

(76) Inventor: Stella Sharon Connelly, Fort Worth, TX (US)

( * ) Notice: Subject to any disclaimer, the term of this patent is extended or adjusted under 35 U.S.C. 154(b) by 597 days.

(21) Appl. No.: 12/544,343

(22) Filed: Aug. 20, 2009

Related U.S. Application Data

(60) Provisional application No. 61/181,265, filed on May 26, 2009.

(51) Int. Cl.
*F26B 19/00* (2006.01)

(52) U.S. Cl. ..... 34/97; 34/98; 34/266; 392/381; 392/384; 248/183.1; 248/316.1; 15/405; 132/118; 132/119.1

(58) Field of Classification Search ..... 34/95, 96, 34/97, 100, 266; 392/381, 384; 15/405; 132/118, 119.1; 248/183.1, 316.1
See application file for complete search history.

(56) References Cited

U.S. PATENT DOCUMENTS

| | | | | | |
|---|---|---|---|---|---|
| 1,607,195 | A * | 11/1926 | Gross | 392/379 |
| 2,152,112 | A * | 3/1939 | Tornberg | 310/40.5 |
| 2,391,964 | A * | 1/1946 | Green | 392/366 |
| 3,150,393 | A * | 9/1964 | Crookes et al. | 15/23 |
| 3,209,127 | A * | 9/1965 | Graves | 392/385 |
| 3,241,560 | A * | 3/1966 | Willat | 132/227 |
| 3,894,549 | A * | 7/1975 | Scivoletto | 132/118 |
| 4,019,260 | A | 4/1977 | Levy et al. | |
| 4,084,491 | A | 4/1978 | Spotts | |
| 4,525,623 | A * | 6/1985 | Da Silva | 392/379 |
| 5,054,211 | A | 10/1991 | Shulman | |
| 5,098,414 | A | 3/1992 | Walker | |
| 5,268,988 | A * | 12/1993 | Miyamoto et al. | 392/380 |
| 5,333,787 | A | 8/1994 | Smith et al. | |
| 5,522,114 | A * | 6/1996 | Allison | 15/320 |
| 5,839,451 | A | 11/1998 | Dorber | |
| 5,841,943 | A * | 11/1998 | Nosenchuck | 392/385 |
| 5,970,622 | A | 10/1999 | Bahman | |
| 6,199,295 | B1 * | 3/2001 | Smal et al. | 34/98 |
| 6,602,122 | B1 * | 8/2003 | Rudolf et al. | 451/344 |
| 6,718,650 | B2 | 4/2004 | Ross | |
| 6,724,984 | B2 * | 4/2004 | Kakuya et al. | 392/412 |
| 6,842,581 | B2 * | 1/2005 | Schafer | 392/380 |
| 7,118,323 | B2 * | 10/2006 | Iyer et al. | 415/53.1 |
| 2005/0081321 | A1 * | 4/2005 | Milligan et al. | 15/344 |
| 2005/0255418 | A1 * | 11/2005 | Goebel | 431/120 |
| 2006/0201119 | A1 * | 9/2006 | Song | 55/471 |
| 2006/0278085 | A1 * | 12/2006 | Kim et al. | 96/140 |

* cited by examiner

*Primary Examiner* — Stephen M. Gravini
(74) *Attorney, Agent, or Firm* — Egbert Law Offices, PLLC

(57) ABSTRACT

A hair dryer includes a housing, a fan unit, a heating element, a motor and a handle. The housing is the body of the hair dryer and has an inlet end and an outlet end. The motor rotates the housing relative to the handle in an oscillating manner. The fan unit is mounted in the housing so that air from vents at the inlet end pass through the fan unit to be blown out through the outlet end of the housing. As such, the housing moves without requiring any movement of the user's hand, wrist, or arm. The handle also has a controller for activating operation, adjusting speed, and setting temperature.

20 Claims, 2 Drawing Sheets

OSCILLATING HAIR DRYER

RELATED U.S. APPLICATIONS

The present application claims priority from U.S. Provisional Patent Application Ser. No. 61/181,265, filed on May 26, 2009 and entitled "OSCILLATING HAIR DRYER."

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to a hair dryer. More particularly, the present invention relates to a hair dryer that oscillates.

2. Description of Related Art

Including Information Disclosed Under 37 CFR 1.97 and 37 CFR 1.98.

A hair dryer is an electromechanical device for blowing cool or hot air over wet or damp hair, in order to accelerate the evaporation of water particles and dry the hair. Hair dryers can be used to give volume and control to a person's hair. Additional use of styling products and hairbrushes during drying add tension, hold and lift. The hair dryer is used with strategic movements of the hand and wrist in both horizontal and vertical motions. The constant motions used must be performed with caution to avoid fatigue and injury to the hand, arm, and wrist. Generally, maintaining position of the wrist, while avoiding strain and overexertion can be a problem during actual use of a hair dryer. Repetitive stress injuries are common to those with frequent and extended use.

In the past, various patents have been issued in the field of hair dryers. For example, U.S. Pat. No. 5,970,622, issued on Oct. 26, 1999 to Bahman, discloses a hair dryer designed to allow drying and styling hair using both hands while controlling the temperature and air flow using one or both feet. An electric hair dryer is mounted to a flexible arm. The flexible arm is connected to a floor stand such that the floor stand supports the flexible arm with the electric hair dryer mounting. An oscillating motor engages the flexible arm through gears so that there is movement of the hair dryer without movement by the user. Various buttons control the speed, temperature and direction of the air flow.

U.S. Pat. No. 5,054,211, issued on Oct. 8, 1991 to Shulman teaches an attachment for a hair dryer, to be secured to the outlet end of the hair dryer. The attachment causes air coming from the hair dryer to split and revolve. An air deflector at the outlet end of the nozzle rotates on an axis parallel to the longitudinal axis of the housing. As such, the deflector uses opposed angle vanes to direct air from the dryer passing through the housing through the opposed angled vanes for deflection and circulating. The flow of air moves without action by the user, causing a swirling air flow.

U.S. Pat. No. 4,019,260, issued on Apr. 26, 1977 to Levy et al., describes an improved hair treatment method and device. The device pulsates to vary the air stream from the nozzle. The device is an attachment to alter the direction and strength of air flow with manual movement of the user's hands, wrists or arms.

U.S. Pat. No. 4,084,491, issued on April 1978 to Spotts and U.S. Pat. No. 5,098,414, issued on Mar. 24, 1992 to Walker, both teach oscillating devices. The '491 Patent describes a box fan with an oscillating device, while the '414 Patent shows a rotating steamer for clothing. These patents describe known oscillating devices in current appliances, similar to the hair dryer. The oscillating action in these inventions show and rotating movement to change the direction of air or steam flow from the outlet end of the device.

U.S. Pat. No. 6,718,650, issued on Apr. 13, 2004 to Ross teaches a personal dryer capable of expelling temperature-controlled air uniformly throughout a dryer and at different areas of the dryer. The suggested application is drying a body after, so as to provide a user with the option of drying their entire body with a more desirable uniformly temperatured air and/or drying different bodily regions with different or varied, user-selectable temperatured air, and wherein such a personal dryer is capable of being pre-programmed to enable a user to dry his/her body in a user-specified regimen or manner.

U.S. Pat. No. 5,839,451, issued on Nov. 24, 1998 to Dorber teaches an implement for the treatment of hair, particularly for the styling and/or drying of hair. The attachment connects to the air exit end of a hair dryer or a hot-air curling brush. The attachment has a main body and at least one active body movable relative to the main body, and an electric motor controls the movement of the active body, which interacts with the hair.

U.S. Pat. No. 5,333,787, issued on Aug. 2, 1994 to Smith et al. describes an oscillating nozzle. The invention includes a stationary segment and an oscillating segment pivoted to the stationary segment. The fluid stream impinges on an inwardly turned lip on the oscillating segment to drive the oscillation. The fluid discharge drives the oscillation of the nozzle. The invention discloses a particular means for oscillation.

It is an object of the present invention to provide a hair dryer with an oscillating ability.

It is an object of the present invention to provide a hair dryer that does not require repetitive motion by the user.

It is another object of the present invention to provide a hair dryer to reduce fatigue and risk of injury due to use.

It is yet another object of the present invention to provide a hair dryer that is light weight and easy to hold and carry.

It is still another object of the present invention to provide a hair dryer that can be used with the wrist in a stable and supported position.

These and other objects and advantages of the present invention will become apparent from a reading of the attached specification and appended claims.

BRIEF SUMMARY OF THE INVENTION

The present invention is a hair dryer comprising a housing, a fan unit, a heating element, a motor and a handle. The housing is the body of the hair dryer and has an inlet end and an outlet end. There is a plurality of vents at the inlet end to allow air to enter the housing. The fan unit has a front side facing the outlet end and a back side facing the inlet end. A sleeve extends between the housing and the handle. The heating element may be heated coils or a series of framed heating coils.

The hair dryer of the present invention has a motor mounted in the handle to power the oscillation of the housing. The motor has a central shaft extending from an end of the motor through the sleeve, a first cam fixedly attached to the central shaft, a pivot shaft mounted on a top of the first cam, a second cam fixedly attached to the pivot shaft, and an attachment peg having an end attached to an interior of the housing. The rotation of the central shaft is transmitted to the attachment peg so that the attachment peg causes the housing to oscillate. As such, the air blown from the housing moves without requiring any movement of the users hand, wrist, or arm. The handle also has a control means mounted on the handle for activating operation, adjusting speed, and setting temperature. The control means can be a slide button or a plurality of buttons corresponding to each setting.

DETAILED DESCRIPTION OF THE INVENTION

Figure 1:
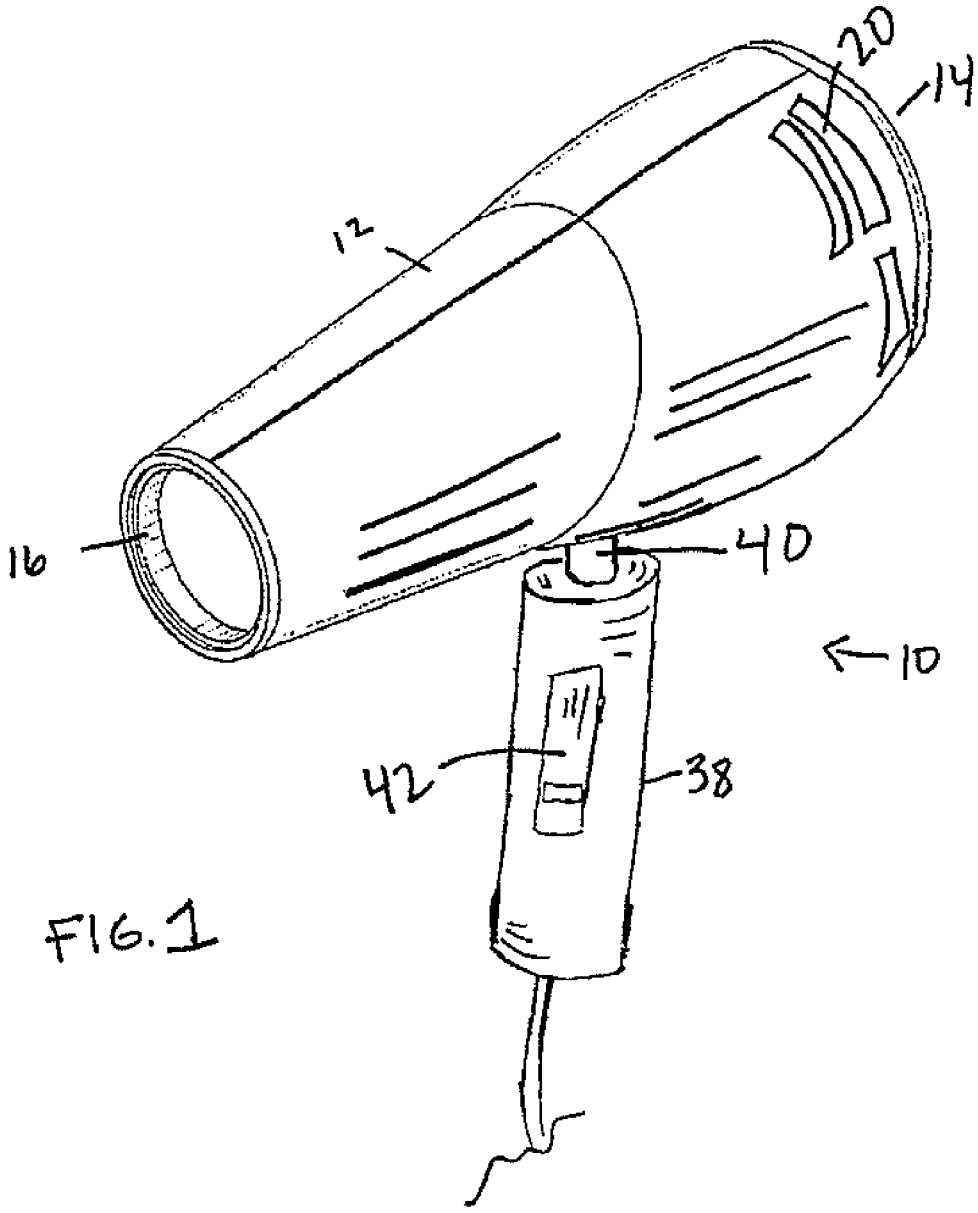
FIG. 1 is a perspective view of the hair dryer of the present invention.
Figure 2:
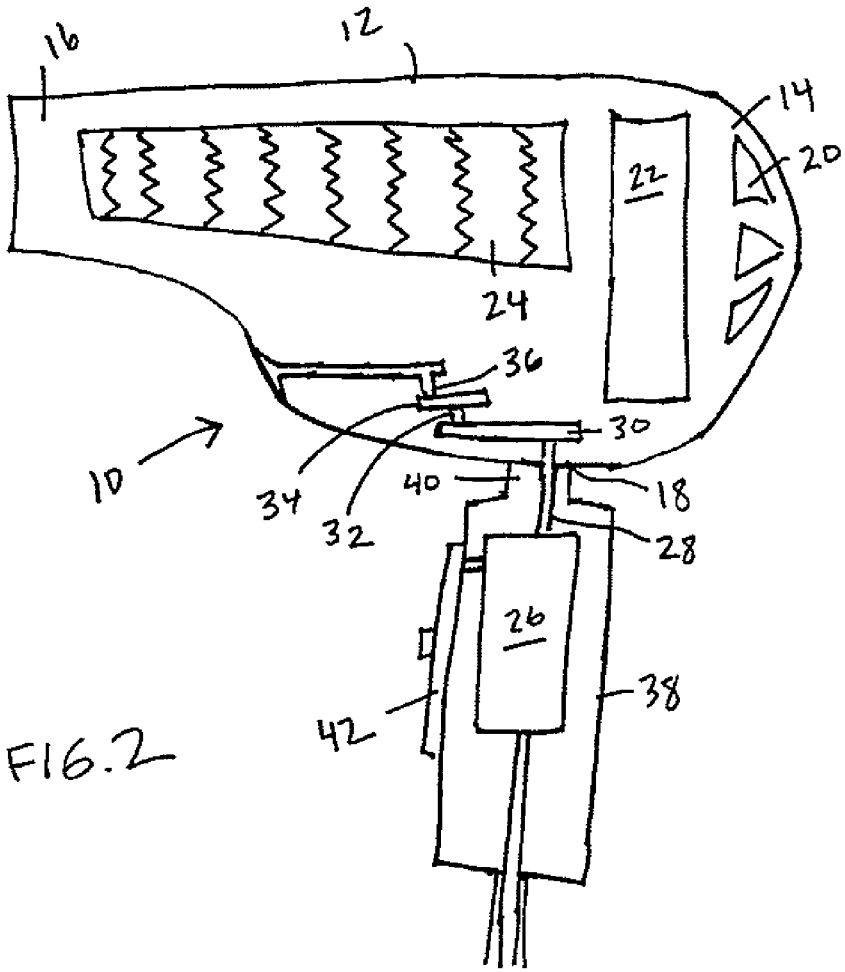
FIG. 2 is a schematic view of the hair dryer of the present invention.

Referring to FIGS. 1 and 2, the hair dryer 10 of the present invention is shown. The housing 12 with a generally tubular shape has an inlet end 14, an outlet end 16 and a mounting hole 18. The inlet end 14 is comprised of a plurality of vents 20 so as to allow air to enter the housing 12 from the atmosphere. The outlet end 16 is an opening for release of air, and the mounting hole 18 is placed on a bottom of the housing 12. Inside the housing 12, there is the fan unit 22. The fan unit 22 is positioned between the outlet end 16 and the inlet end 14, although closer to the inlet end 14 with the vents 20. The vents 20 pass air to the back side of the fan unit 22, while the front face of the fan unit 22 propels air outward toward the outlet end 16 of the housing 12. There is also a heating element 24 within the housing 12. The heating element 24 is positioned closer to the outlet end 16 and in front of the front side of the fan unit 22. The heating element 24 can be heated coils, such as a set of heating coils. In this manner, air enters the housing 12 through the vents 20 so that the fan unit 22 passes the air over the heating element 24 to elevate the temperature of the air exiting the outlet end 16 of the housing 12.

The hair dryer 10 of the present invention has a motor 26 to power the oscillation of the housing 12 and the air flow portion of the hair dryer 10. The motor 26 has a central shaft 28 extending from an end of the motor 26, a first cam 30 fixedly attached to the central shaft 28, a pivot shaft 32 mounted on a top of the first cam 30, a second cam 34 fixedly attached to the pivot shaft 32, and an attachment peg 36 having an end attached to an interior of the housing 12. The housing 12 oscillates as the attachment peg 36 is rotated by the central shaft 28 of the motor 26. As such, the air blown from the housing 12 moves without any corresponding movement of the hand, wrist, or arm of the user.

Figure 3:
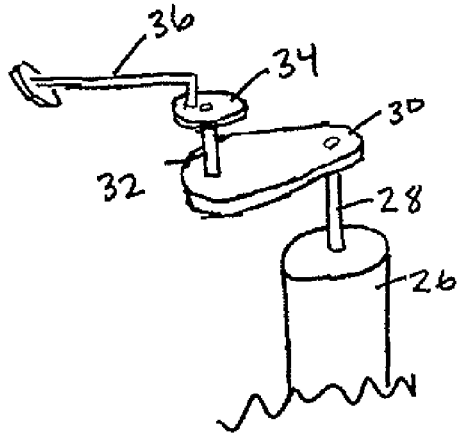
FIG. 3 is an isolated schematic view of the motor and attachments of the hair dryer of the present invention.

The motor 26 includes linkages to translate the rotational movement of the central shaft 28 of the motor 26 to the housing 12. As shown in FIG. 3, the first cam 30 has an oblong shape with the pivot shaft 32 placed at an opposite side and opposite end from the central shaft 28. The rotation of the central shaft 28 displaces the pivot shaft 32. The second cam 34 has a circular shape with the attachment peg 36 attached near an edge of the second cam 34. The rotation of the second cam 34 rotates the attachment peg 36. The attachment peg 36 is fixedly attached to the second cam 34 and the interior of the housing; as such, the attachment peg 36 actuates the entire housing 12 to rotate at the mounting hole 18 of the housing.

The motor 26 is contained in a handle 38, and the central shaft 28 of the motor 26 extends through a sleeve 40 to the housing 12. The handle 38 can have a contoured surface so as to facilitate gripping. The sleeve 40 is rotatably placed between the housing 12 at the mounting hole 18 and the handle 38. The sleeve 40 protects the connections from the air blowing structures to the handle and power source. The sleeve 40 is generally a tubular member, and other electric wires and connections can be made through the sleeve 40 between the housing 12 and the handle 38.

Importantly, the hair dryer 10 may include a control means 42 on a surface of the handle 38. The control means 42 longitudinally extends along the length of the handle 38 for possible one-handed operation by the user. The control means 42 activates operation of the hair dryer 10, adjusts air flow speed of the fan unit 22, and sets temperature of the heating element 24. Various structures of the control means 42 include a slide button or a plurality of buttons corresponding to each function.

The hair dryer of the present invention has the ability to oscillate. Repetitive movements are no longer required to operate the device properly. The oscillating movement of the hair dryer reduces fatigue and risk of injury due to use because the hair dryer can be used with the wrist of the user in a stable and supported position. The user is able to dry a complete head of hair with fewer movements. The hair dryer of the present invention is light weight, and additional components are compactly stored in the handle. So, the hair dryer remains easy to hold and carry.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An apparatus comprising:

a hair dryer having a housing having an inlet end and an outlet end, said hair dryer having a fan unit positioned within said housing, said hair dryer having a heating element positioned within said housing;

a handle rotatably connected to said housing of said hair dryer; and a motor means positioned within said handle for rotating said housing relative to said handle.

2. The apparatus of claim 1, said inlet end comprising a plurality of vents.

3. The apparatus of claim 1, said fan unit having a front side and a back side, said front side facing said outlet end, said back side facing said inlet end.

4. The apparatus of claim 1, further comprising:

a sleeve extending between said housing and said handle.

5. The apparatus of claim 1, said heating element being heated coils.

6. The apparatus of claim 1, said heating element being a series of framed heating coils.

7. The apparatus of claim 1, further comprising:

a central shaft extending from an end of said motor through said sleeve.

8. The apparatus of claim 7, further comprising:

a first cam fixedly attached to said central shaft;

a pivot shaft mounted on a top of said first cam;

a second cam fixedly attached to said pivot shaft, and an attachment peg having an end attached to an interior of said housing, said first cam having a oblong shape with said pivot shaft placed at an opposite side and opposite end from said central shaft, wherein rotation of said central shaft displaces said pivot shaft, said second cam having a circular shape with said attachment peg attached near an edge of said second cam, wherein rotation of said second cam rotates said attachment peg, said attachment peg being fixedly attached to said second cam and said interior of said housing, wherein rotation of said attachment peg rotates the housing for an oscillating movement.

9. The apparatus of claim 1, further comprising:

a control means mounted on said handle for activating operation, adjusting speed, and setting temperature, said control means being in communication with said motor means.

10. The apparatus of claim 9, said control means being a slide button.

11. The apparatus of claim 9, said control means comprising:

a first button for activating operation;

a second button for adjusting speed; and a third button for setting temperature.

12. The apparatus of claim 1, said handle having a contoured surface so as to facilitate gripping.

13. An apparatus comprising:

a hair dryer housing, said housing having an inlet end and an outlet end and a mounting hole, said mounting hole formed on a bottom of said housing, said hair dryer having a fan unit positioned within said housing, said hair dryer having a heating element positioned within said housing between said fan unit and said outlet end;

a sleeve positioned within mounting hole and extending downwardly therefrom;

a handle affixed to said sleeve;

a motor positioned within said handle, said motor having a central shaft extending from an end of said motor through said sleeve; and an oscillation means affixed to said housing and to an end of said central shaft opposite said motor, said oscillation means for rotating said housing about a longitudinal axis of said handle.

14. The apparatus of claim 13, said oscillation means comprising:

a first cam fixedly attached to said central shaft;

a pivot shaft mounted on a top of said first cam;

a second cam fixedly attached to said pivot shaft, and an attachment peg having an end attached to an interior of said housing, said first cam having a oblong shape with said pivot shaft placed at an opposite side and opposite end from said central shaft, wherein rotation of said central shaft displaces said pivot shaft, said second cam having a circular shape with said attachment peg attached near an edge of said second cam, wherein rotation of said second cam rotates said attachment peg, said attachment peg being fixedly attached to said second cam and said interior of said housing, wherein rotation of said attachment peg rotates the housing for an oscillating movement.

15. The apparatus of claim 13, further comprising:

a control means mounted on said handle for activating operation, adjusting speed, and setting temperature, said control means mounted on said handle and in communication with said motor.

16. The apparatus of claim 15, said control means being a slide button.

17. The apparatus of claim 15, said control means comprising:

a first button for activating operation;

a second button for adjusting speed; and a third button for setting temperature.

18. The apparatus of claim 15, said handle having a contoured surface so as to facilitate gripping.

19. The apparatus of claim 15, said heating element being heated coils.

20. A apparatus comprising:

a hair dryer having a housing having an inlet end and an outlet end, said housing having a mounting hole on a bottom thereof, said hair dryer having a fan unit positioned within said housing, said hair dryer having a heating element positioned within said housing between said fan unit and said outlet end;

a sleeve extending downwardly from said mounting hole;

a handle affixed to said sleeve;

a motor positioned within said handle;

a central shaft extending from an end of said motor through said sleeve;

a first cam fixedly attached to said central shaft;

a pivot shaft mounted on a top of said first cam;

a second cam fixedly attached to said pivot shaft, and an attachment peg having an end attached to an interior of said housing, said first cam having a oblong shape with said pivot shaft placed at an opposite side and opposite end from said central shaft, wherein rotation of said central shaft displaces said pivot shaft, said second cam having a circular shape with said attachment peg attached near an edge of said second cam, wherein rotation of said second cam rotates said attachment peg, said attachment peg being fixedly attached to said second cam and said interior of said housing, wherein rotation of said attachment peg rotates the housing for an oscillating movement.

* * * * *